US011245232B2

(12) United States Patent
Oosaka

(10) Patent No.: US 11,245,232 B2
(45) Date of Patent: Feb. 8, 2022

(54) CONNECTOR TO REDUCE ABRASION OF LOCK PROTRUSIONS AND IMPROVE SIGNAL TRANSMISSION CHARACTERISTICS

(71) Applicant: JAPAN AVIATION ELECTRONICS INDUSTRY, LIMITED, Tokyo (JP)

(72) Inventor: Junji Oosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/738,329

(22) Filed: Jan. 9, 2020

(65) Prior Publication Data

US 2020/0313360 A1 Oct. 1, 2020

(30) Foreign Application Priority Data

Mar. 26, 2019 (JP) ..... JP2019-057622

(51) Int. Cl.
*H01R 13/6585* (2011.01)
*H01R 13/6461* (2011.01)
(Continued)

(52) U.S. Cl.
CPC ..... *H01R 13/6585* (2013.01); *H01R 13/6273* (2013.01); *H01R 13/6461* (2013.01); *H01R 13/26* (2013.01)

(58) Field of Classification Search
CPC ..... H01R 13/6585; H01R 13/6273; H01R 13/6461; H01R 13/26
(Continued)

(56) References Cited

U.S. PATENT DOCUMENTS 8,968,031 B2 * 3/2015 Simmel ..... H01R 13/6594 439/660
9,437,957 B2 * 9/2016 Lee ..... H01R 13/5202
(Continued)

FOREIGN PATENT DOCUMENTS

CN 204304072 U 4/2015
CN 206211128 U 5/2017
(Continued)

OTHER PUBLICATIONS

Taiwanese Office Action (and English language translation thereof) dated Sep. 4, 2020 issued in counterpart Taiwanese Application No. 108147191.
(Continued)

*Primary Examiner* — Peter G Leigh
(74) *Attorney, Agent, or Firm* — Holtz, Holtz & Volek PC

(57) ABSTRACT

Each of contact portion rows 310 and 320 includes an outer contact portion 212 and an inner contact portion 216 forming a differential pair. In a Y-direction, the outer contact portion 212 and the inner contact portion 216 of the contact portion row 310 are located at same positions as those of the other contact portion row 320, respectively. A main portion 430 of a mid-plate 400 is located between the contact portion rows 310 and 320 in a Z-direction. Between the main portion 430 and each lock portion 450, a space 500 is provided to allow resilient deformation of a spring portion 460. A side edge 432 of the main portion 430 that oriented outward in the Y-direction is located between an inner edge 212A of the outer contact portion 212 and the lock portion 450 in the Y-direction.

4 Claims, 7 Drawing Sheets

(51) Int. Cl.
*H01R 13/627* (2006.01)
*H01R 13/26* (2006.01)

(58) Field of Classification Search
USPC ..... 439/353
See application file for complete search history.

(56) References Cited

U.S. PATENT DOCUMENTS

| | | | | |
|---|---|---|---|---|
| 9,478,923 | B2 * | 10/2016 | Kao | H01R 24/60 |
| 9,601,876 | B2 * | 3/2017 | Jiang | H01R 24/50 |
| 9,620,904 | B2 * | 4/2017 | Kao | H01R 13/6582 |
| 9,647,369 | B2 * | 5/2017 | Tsai | H01R 24/62 |
| 9,762,009 | B2 * | 9/2017 | Little | H01R 13/6591 |
| 9,837,772 | B2 * | 12/2017 | Tsai | H01R 13/502 |
| 9,960,552 | B2 * | 5/2018 | Tsai | H01R 13/6585 |
| 10,170,867 | B2 * | 1/2019 | Ju | H01R 13/6581 |
| 10,411,412 | B2 | 9/2019 | Chu | |
| 10,411,413 | B2 | 9/2019 | Feng | |
| 10,574,003 | B2 | 2/2020 | Cheng | |
| 10,587,079 | B2 | 3/2020 | Ba | |
| 2013/0330976 | A1 | 12/2013 | Simmel et al. | |
| 2015/0214674 | A1 | 7/2015 | Simmel et al. | |
| 2015/0244111 | A1 * | 8/2015 | Ju | H01R 24/60 439/607.05 |
| 2015/0255905 | A1 * | 9/2015 | Little | H01R 13/6658 439/78 |
| 2015/0295362 | A1 * | 10/2015 | Tziviskos | H01R 13/6581 439/607.01 |
| 2015/0340825 | A1 * | 11/2015 | Ng | H01R 13/2442 439/607.28 |
| 2016/0197443 | A1 * | 7/2016 | Zhang | H01R 12/716 439/607.05 |
| 2017/0222342 | A1 * | 8/2017 | Ho | H01R 13/6585 |
| 2017/0271822 | A1 * | 9/2017 | Zhang | H01R 13/6585 |
| 2017/0302035 | A1 * | 10/2017 | Ju | H01R 13/6583 |
| 2018/0191102 | A1 * | 7/2018 | Arai | H01R 24/60 |
| 2018/0205183 | A1 * | 7/2018 | Zhao | H01R 13/6585 |
| 2019/0036276 | A1 * | 1/2019 | Chu | H01R 13/6594 |
| 2019/0044287 | A1 * | 2/2019 | Lin | H01R 13/502 |
| 2019/0052024 | A1 * | 2/2019 | Zhao | H01R 13/405 |

FOREIGN PATENT DOCUMENTS

| | | | | |
|---|---|---|---|---|
| CN | 206524477 | * | 9/2017 | |
| CN | 206524477 | U | 9/2017 | |
| CN | 108493717 | A | 9/2018 | |
| CN | 208571041 | U | 3/2019 | |
| JP | 2017098052 | A | 6/2017 | |
| TW | M506393 | U | 8/2015 | |
| TW | M541138 | * | 5/2017 | H01R 24/20 |
| TW | M541138 | U | 5/2017 | |
| TW | M549975 | U | 10/2017 | |
| TW | M553061 | U | 12/2017 | |

OTHER PUBLICATIONS

Chinese Office Action (and English language translation thereof) dated Mar. 25, 2021 issued in counterpart Chinese Application No. 202010076609.2.

Chinese Office Action (and English translation thereof) dated Sep. 23, 2021, issued in counterpart Chinese Application No. 202010076609.2.

* cited by examiner

CONNECTOR TO REDUCE ABRASION OF LOCK PROTRUSIONS AND IMPROVE SIGNAL TRANSMISSION CHARACTERISTICS

CROSS REFERENCE TO RELATED APPLICATIONS

This application is based on and claims priority under 35 U.S.C. § 119 to Japanese Patent Application No. JP2019-057622 filed Mar. 26, 2019, the contents of which are incorporated herein in their entirety by reference.

BACKGROUND OF THE INVENTION

This invention relates to a connector provided with lock portions and a mid-plate.

Referring to FIGS. 13 and 14, a connector 900 of Patent Document 1 (JP2017-98052A) is provided with a plurality of contacts 910, a holding member 920 and lock members 930. The contacts 910 are held by the holding member 920. Contact portions of the contacts 910 are divided into two rows in a Z-direction. The contact portions of each of the rows are arranged in a Y-direction. The contacts 910 include contacts 912 forming differential pairs for high-speed signal transmission. The contact portions of the contacts 912 included in one of the rows are located at positions same as those of the contact portions of the contacts 912 included in the other of the rows in the Y-direction. The lock members 930 are also held by the holding member 920. Specifically, in Patent Document 1, the lock members 930 are press-fitted into the holding member 920. Each of the lock members 930 has a spring portion 932 which is resiliently deformable and a lock protrusion 934 which is supported by the spring portion 932. A space 940 is provided inward of the spring portion 932 in the Y-direction to allow resilient deformation of the spring portion 932. When the connector 900 is mated with a mating connector 950 to be in a mated state, mating lock portions 952 of the mating connector 950 and the lock members 930 lock the mated state.

As mentioned above, in the connector of Patent Document 1, the lock protrusions 934 are supported by the spring portions 932, respectively. With this structure, abrasion of the lock protrusions 934 is reduced when the connector 900 is mated with the mating connector 950, and thereby, the durability of the connector 100 is improved.

SUMMARY OF THE INVENTION

For the connector of Patent Document 1, there is a demand to improve transmission characteristics thereof.

It is therefore an object of the present invention to provide a connector which can reduce abrasion of lock protrusions thereof and improve transmission characteristics thereof.

One aspect of the present invention provides a connector which is mateable, along a first direction, with a mating connector having mating lock portions. The connector comprises a connector body. The connector body comprises a holding member, a plurality of contacts, a mid-plate and two lock portions. The holding member has a plate-like portion. The plurality of the contacts includes contacts forming at least two differential pairs. Each of the contacts has a contact portion. The contact portions of the contacts are held by the plate-like portion to form two contact portion rows. In each of the contact portion rows, the contact portions are arranged in a second direction perpendicular to the first direction and exposed from the plate-like portion in a third direction perpendicular to both of the first direction and the second direction. Each of the contact portion rows includes the contact portions of the contacts forming at least one of the differential pairs. The contact portions of the contacts forming each of the differential pairs comprise an outer contact portion located outward in the second direction and an inner contact portion located inward in the second direction. The outer contact portion has an inner edge oriented inward in the second direction and an outer edge oriented outward in the second direction. In the second direction, the outer contact portion and the inner contact portion which are included in one of the contact portion rows are respectively located at positions same as positions of the outer contact portion and the inner contact portion which are included in a remaining one of the contact portion rows. Each of the lock portions has a spring portion and a lock protrusion supported by the spring portion. The lock protrusion protrudes outward in the second direction. The lock portions and the mating lock portions are designed to lock a mated state of the connector and the mating connector. The mid-plate has a main portion with a plate-like shape. The main portion is held by the plate portion. The main portion is located between and apart from the lock portions in the second direction and located between the contact portion rows in the third direction. The main portion has side edges oriented outward in the second direction. Between the main portion and each of the lock portions, a space is provided to allow resilient deformation of the spring portion. One of the side edges of the main portion is located between the inner edge of the outer contact portion and one of the lock portions that is closer to the outer contact portion in the second direction.

Each of the lock portions of the connector of the present invention has the spring portion which is resiliently deformable and the lock protrusion which is supported by the spring portion. Moreover, the connector is provided with the space to allow resilient deformation of the spring portion. Accordingly, similarly to that of Patent Document 1, abrasion of the lock protrusion of the connector is reduced when the connector is mated with the mating connector, and thereby the durability of the connector is improved.

In the connector of the present invention, the main portion of the mid-plate is located between the differential pairs, i.e. the contact portions of the contacts forming the differential pairs, in the third direction, and one of the side edges of the main portion is located between the inner edges of the outer contact portions of the differential pairs and one of the lock portions in the second direction. In other words, the inner contact portions of the differential pairs are partitioned by the main portion. Moreover, the inner contact portion of one of the contact portion rows and the outer contact portion of the other of the contact portion rows are also partitioned by the main portion. Furthermore, the outer contact portions of the differential pairs are partitioned by the main portion at least in part. Therefore, cross talk between the differential pairs is suppressed, and thereby transmission characteristics of the connector are improved.

An appreciation of the objectives of the present invention and a more complete understanding of its structure may be had by studying the following description of the preferred embodiment and by referring to the accompanying drawings.

Figure 1:
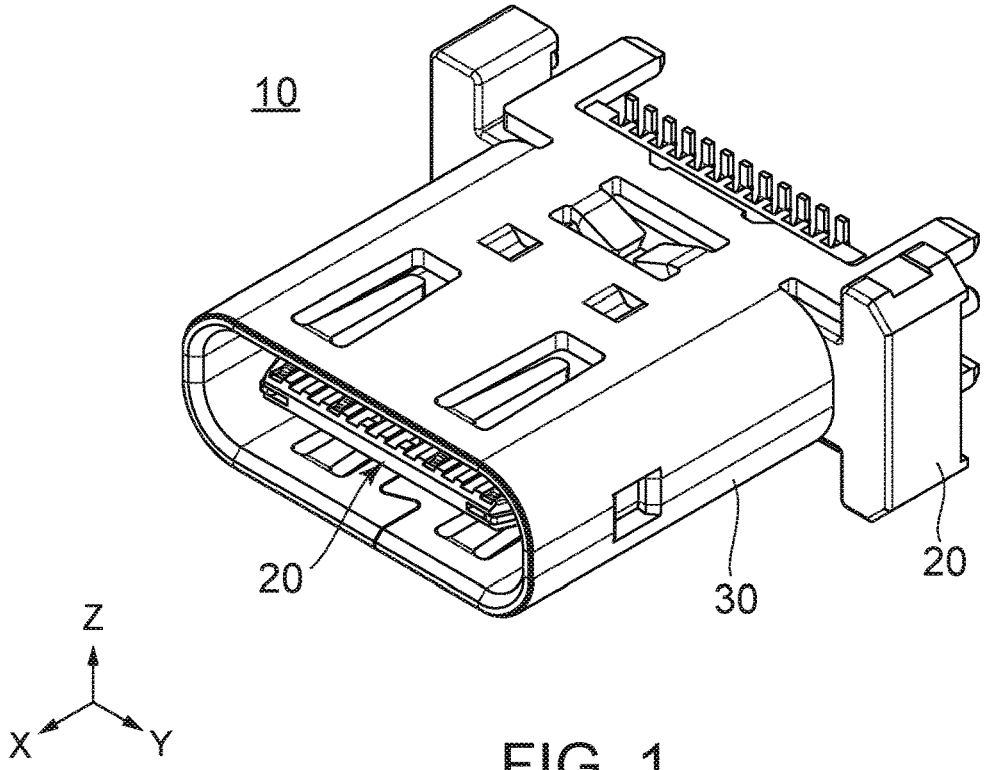
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
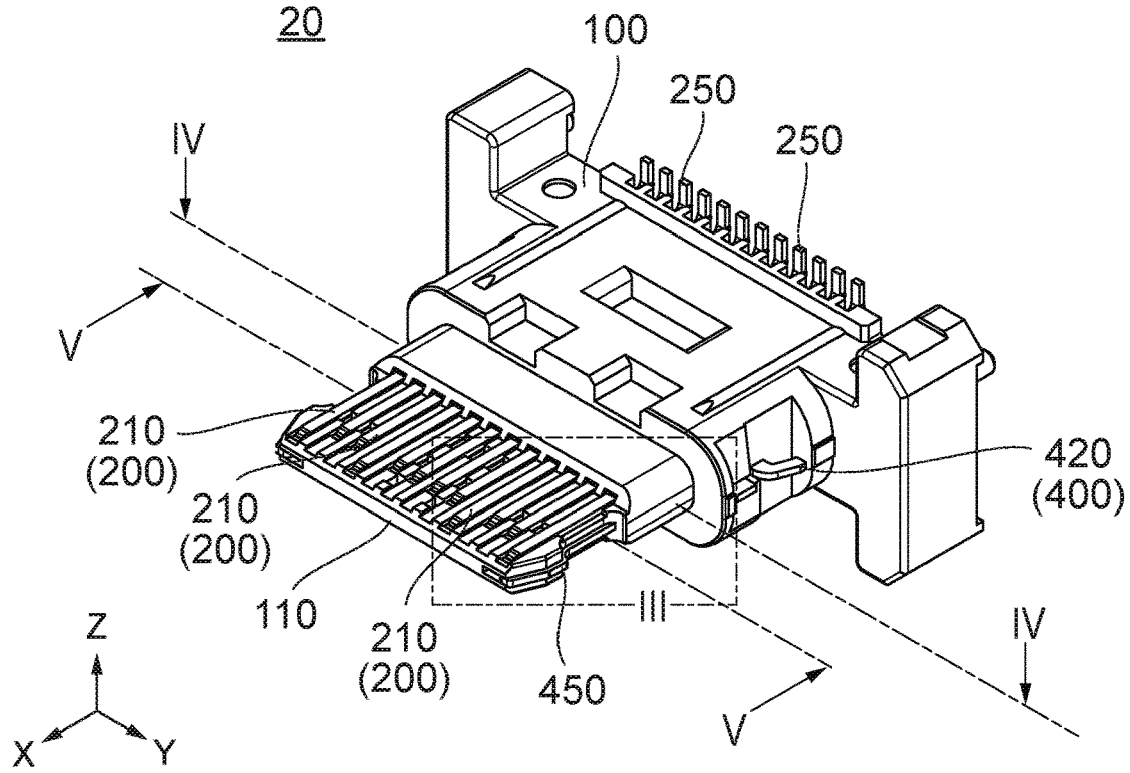
FIG. 2 is a perspective view showing a connector body included in the connector of FIG. 1.
Figure 3:
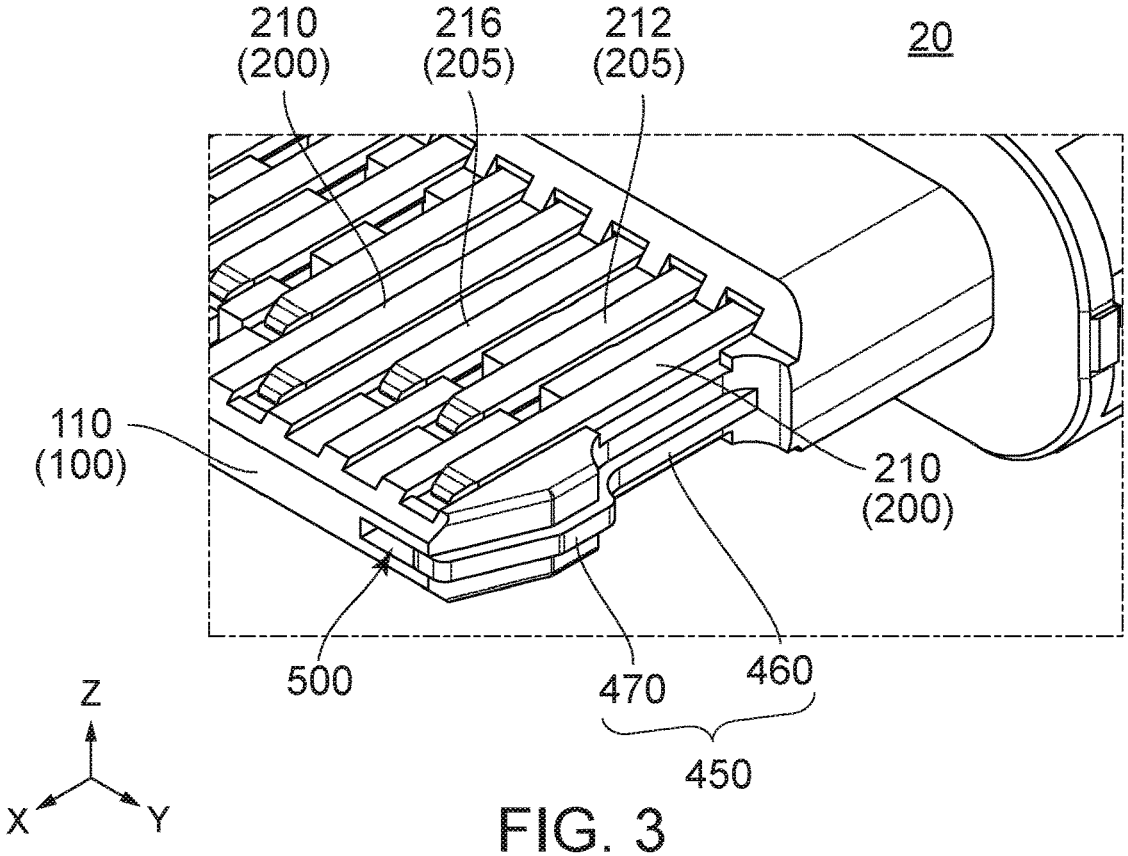
FIG. 3 is an enlarged, perspective view showing a part of the connector body of FIG. 2 that is surrounded by a rectangular frame III.

As shown in FIGS. 1 and 2, a connector 10 according to the present embodiment is provided with a connector body 20 and a shell 30 covering the connector body 20 in part. The connector 10 may consist only of the connector body 20. In other words, the connector 10 may not be provided with the shell 30. The connector 10 according to the present embodiment is a receptacle having a contact arrangement same as that of a receptacle of universal serial bus (USB) TYPE-C.

Figure 10:
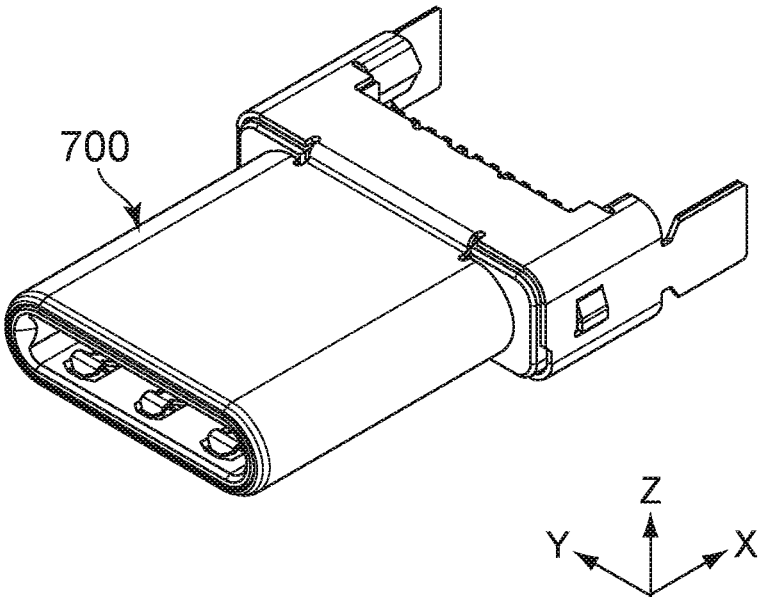
FIG. 10 is a perspective view showing a mating connector.
Figure 11:
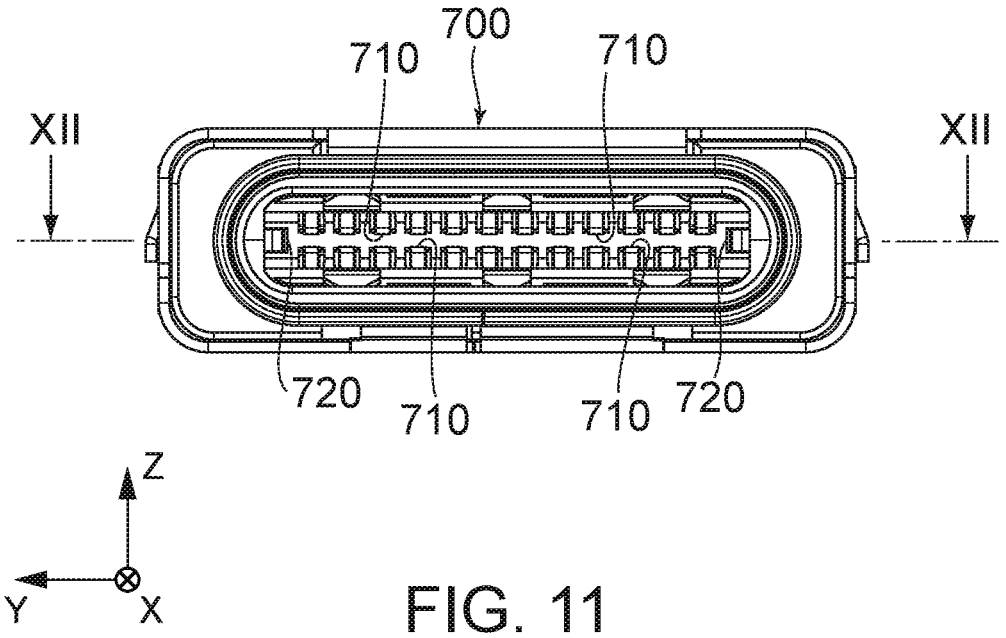
FIG. 11 is a front view showing the mating connector of FIG. 10.
Figure 12:
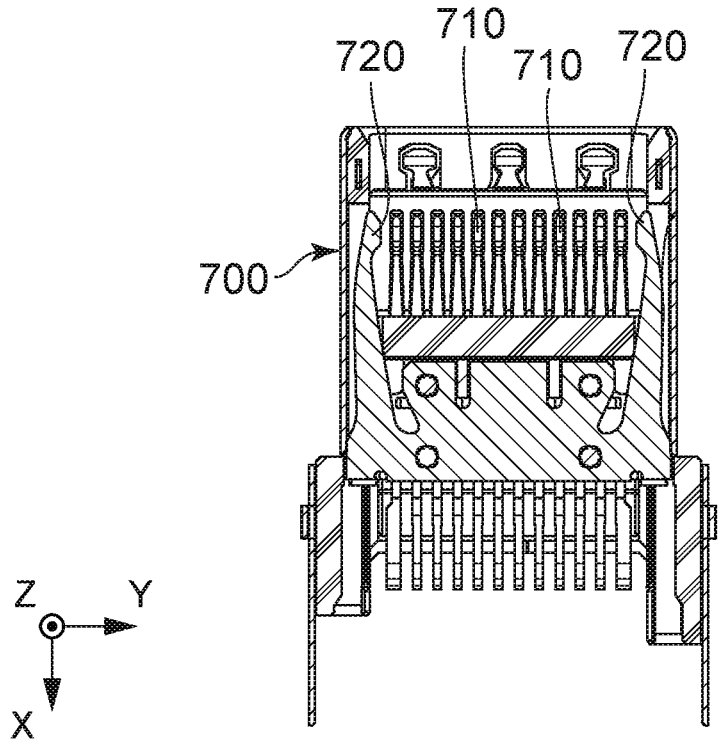
FIG. 12 is a cross-sectional view showing the mating connector of FIG. 11, taken along line XII-XII.
Figure 13:
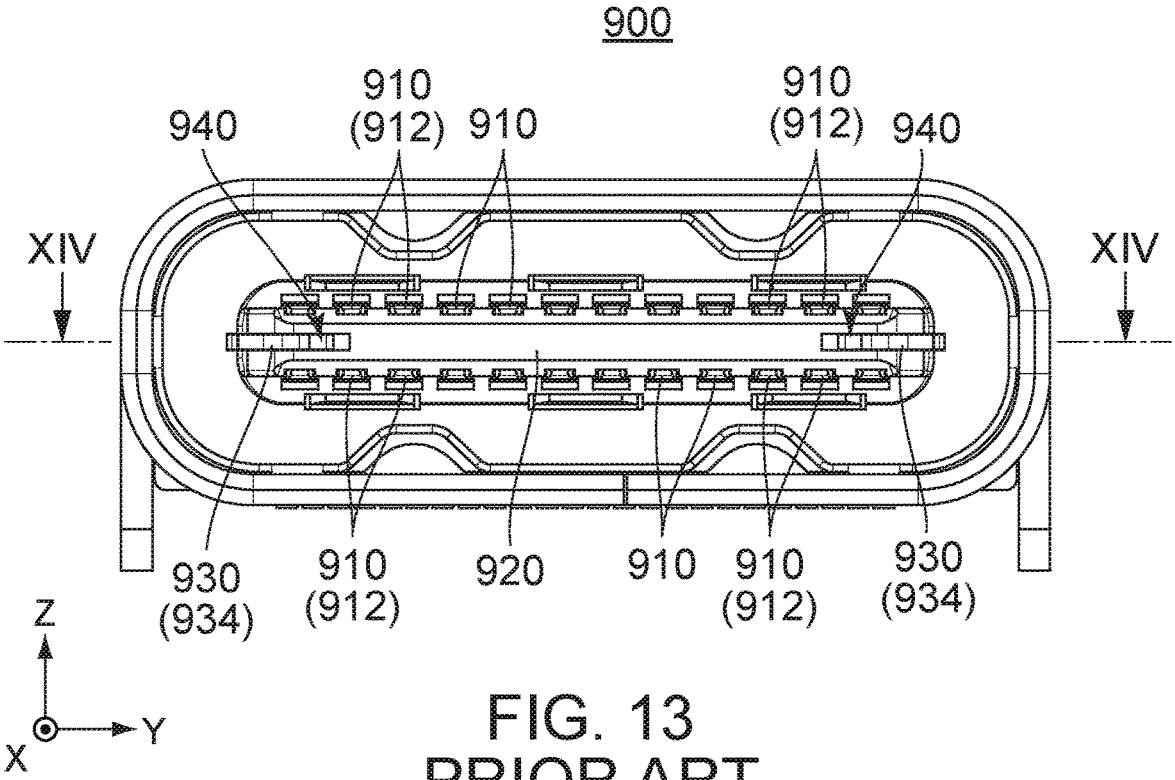
FIG. 13 PRIOR ART
FIG. 13 is a front view showing a connector of Patent Document 1.
Figure 14:
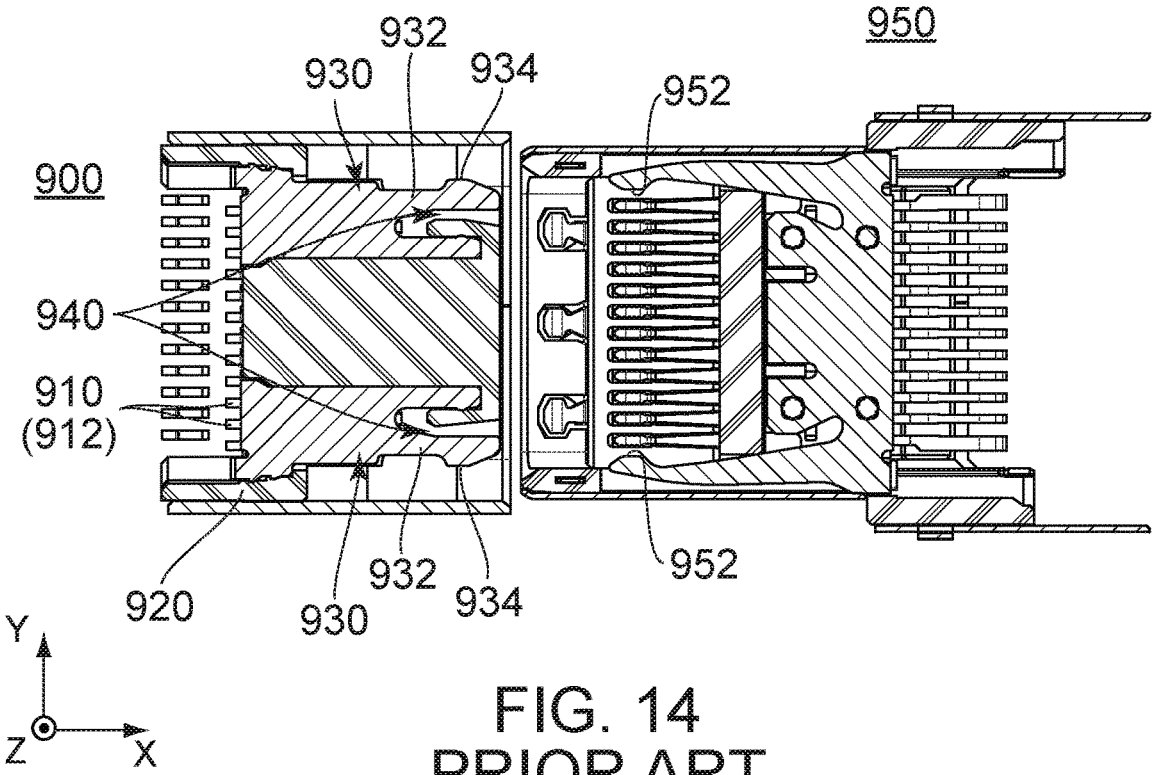
FIG. 14 PRIOR ART
FIG. 14 is a cross-sectional view showing the connector and a mating connector of Patent Document 1.

The connector 10 of FIG. 1 is mateable with a mating connector 700 shown in FIGS. 10 to 12 along a first direction. In the present embodiment, the first direction is an X-direction. The X-direction is also referred to as a mating direction or a front-rear direction. In particular, a positive X-direction is directed forward while a negative X-direction is directed rearward. Referring to FIGS. 10 to 12, the mating connector 700 has mating contacts 710 and mating lock portions 720. An example of the mating connector 700 according to the present embodiment is a plug of USB TYPE-C.

Figure 4:
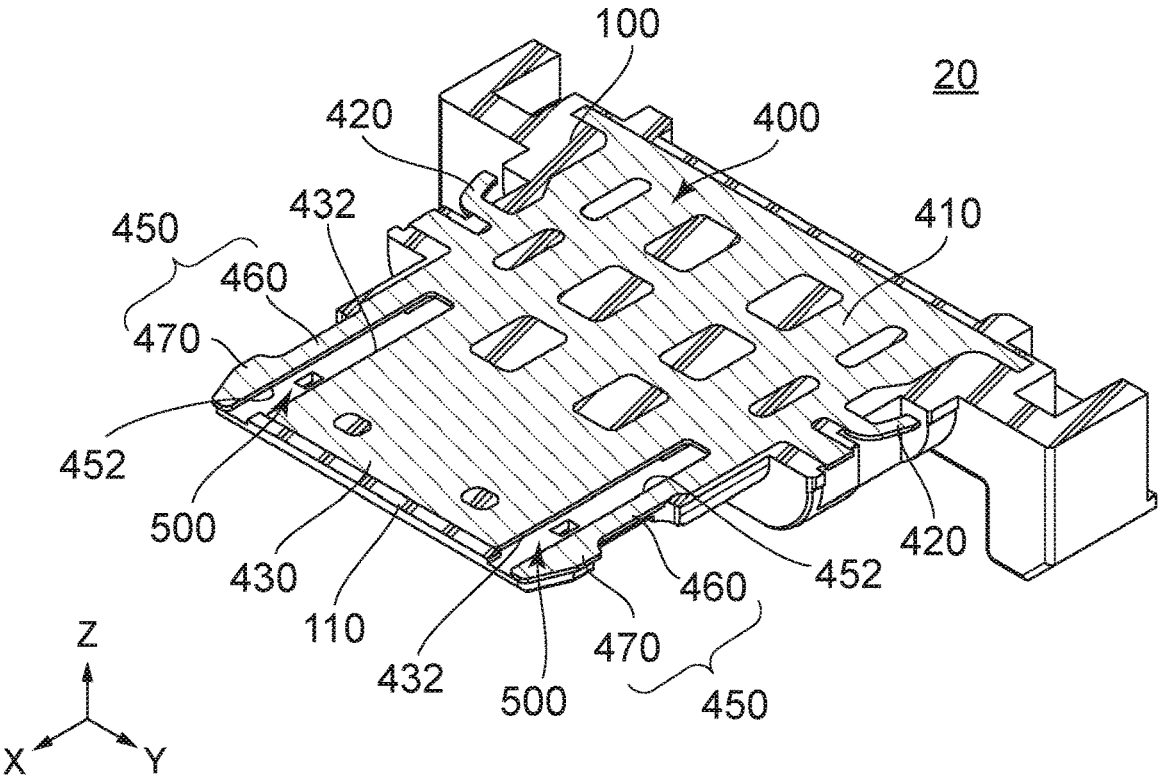
FIG. 4 is a perspective, cross-sectional view showing the connector body of FIG. 2, taken along line IV-IV.
Figure 5:
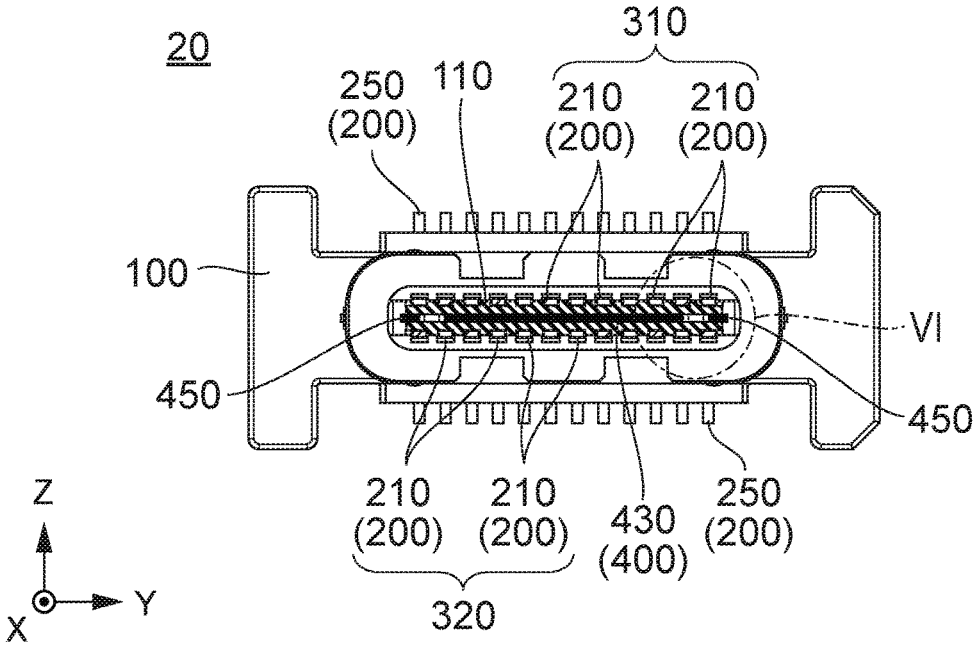
FIG. 5 is a cross-sectional view showing the connector body of FIG. 2, taken along line V-V.

Referring to FIGS. 2, 4 and 5, the connector body 20 is provided with a holding member 100, a plurality of contacts 200 and a mid-plate 400.

The holding member 100 is made of insulator and has a plate-like portion 110 having an approximately plate-like shape or a tongue-like shape.

Each of the contacts 200 is made of a conductive material and has a contact portion 210 and a fixed portion 250. Referring to FIGS. 1, 2, 10 and 11, the contact portion 210 is a part to be in contact with the mating contact 710 of the mating connector 700 in a state that the connector 10 and the mating connector 700 are mated with each other. Referring to FIGS. 1 and 2, the fixed portion 250 is a part to be fixed on a circuit board (not shown) when the connector 10 is mounted on the circuit board. As understood from FIG. 2, the circuit board (not shown) is a substrate parallel to a Y-Z plane. Accordingly, in the present embodiment, the mating direction of the connector 10 is perpendicular to the circuit board. However, the present invention is not limited thereto. The mating direction of the connector 10 may extend in a direction parallel to the circuit board, for example.

The plurality of the contacts 200 includes contacts 205 forming at least two differential pairs. The contacts 200 of the present embodiment include the contacts 205 forming two differential pairs for low-speed signal transmission and four differential pairs for high-speed signal transmission.

Figure 6:
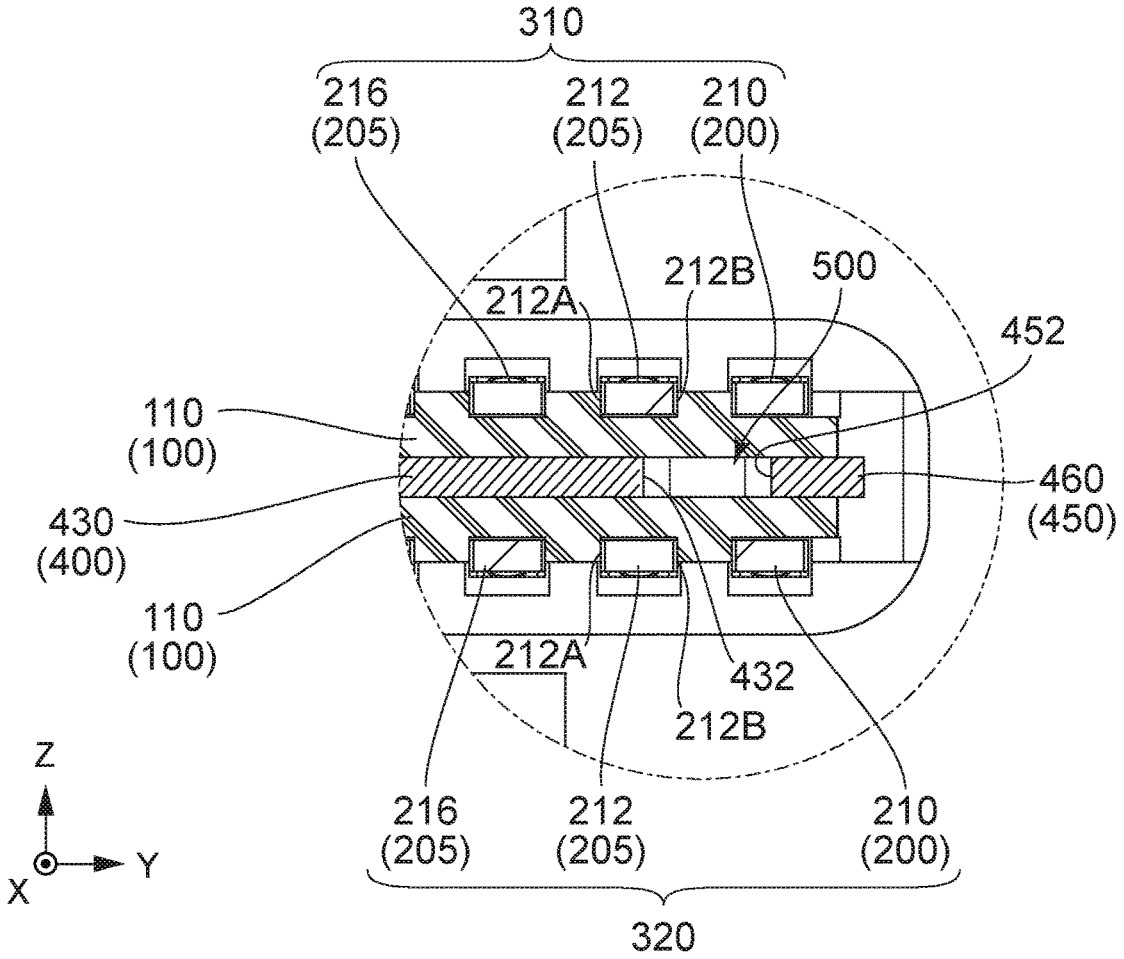
FIG. 6 is an enlarged, cross-sectional view showing a part of the connector body of FIG. 5 that is surrounded by a circle VI.

As shown in FIGS. 5 and 6, the contact portions 210 are held by the plate-like portion 110 and form two contact portion rows 310 and 320. Each of the contact portion rows 310 and 320 according to the present embodiment consists of a total of twelves of the contact portions 210.

In each of the contact portion rows 310 and 320, the contact portions 210 are arranged in a second direction perpendicular to the first direction and exposed from the plate-like portion 110 in a third direction perpendicular to both of the first direction and the second direction. In the present embodiment, the second direction is a Y-direction. The second direction is also referred to as a pitch direction or a lateral direction. Moreover, in the present embodiment, the third direction is a Z-direction. The third direction is also referred to as an up-down direction. In particular, a positive Z-direction is directed upward while a negative Z-direction is directed downward. Thus, the contact portion row 310 is an upper contact portion row, and the contact portion row 320 is a lower contact portion row.

Referring to FIG. 6, each of the contact portion rows 310 and 320 includes contact portions 212 and 216 of the contacts 205 forming at least one of the differential pairs. In the present embodiment, each of the contact portion rows 310 and 320 includes the contact portions 212 and 216 of the contacts 205 forming two of the differential pairs. Specifically, in each of the contact portion rows 310 and 320, the contact portions 210 located at second and third positions in the second direction and the contact portions 210 located at eleventh and tenth positions in the second direction are the contact portions 212 and 216 forming the differential pairs for the high-speed signal transmission. Moreover, in each of the contact portion rows 310 and 320, the contact portions 210 located at sixth and seventh positions in the second direction form the differential pair for the low-speed signal transmission.

In each of the contact portion rows 310 and 320, the contact portions 212 and 216 of the contacts 205 forming each of the differential pairs except for the differential pair located at the middle in the second direction consist of an outer contact portion 212 located outward in the second direction and an inner contact portion 216 located inward in the second direction. Specifically in the present embodiment, the contact portions 212 and 216 of the contacts 205 forming each of the differential pairs for the high-speed signal transmission consist of the outer contact portion 212 located outward in the second direction and the inner contact portion 216 located inward in the second direction. The outer contact portion 212 has an inner edge 212A oriented inward in the second direction and an outer edge 2128 oriented outward in the second direction. In the second direction, the outer contact portions 212 and the inner contact portions 216 included in one of the contact portion rows, e.g. the contact portion row 310, are respectively located at positions same as positions of the outer contact portions 212 and the inner contact portions 216 included in the other of the contact portion rows, e.g. the contact portion row 320. In other words, the outer contact portions 212 and the inner contact portions 216 included in the contact portion row 310 are respectively juxtaposed with the outer contact portions 212 and the inner contact portions 216 included in the contact portion row 320 in the third direction.

Referring to FIG. 4, the mid-plate 400 according to the present embodiment has a base portion 410, shell contact portions 420, a main portion 430 and two lock portions 450. In the present embodiment, the lock portions 450 are integrally formed with the mid-plate 400. However, the present invention is not limited thereto. The lock portions 450 may be formed as members distinct from the mid-plate 400, for example.

Although the mid-plate 400 according to the present embodiment is formed by stamping a metal sheet, the present invention is not limited thereto. The lock portions 450 may be formed by stamping a metal sheet, further followed by bending it, for example.

In the present embodiment, the mid-plate 400 is partly embedded in the holding member 100 by insert molding. In other words, the mid-plate 400 is embedded in the holding member 100 in part. However, the present invention is not limited thereto. The mid-plate 400 may be press-fitted into the holding member 100 in part, for example.

As shown in FIG. 4, each of the shell contact portions 420 has an L-shape generally and protrudes outward in the second direction from the base portion 410. Referring to FIGS. 1, 2 and 4, each of the shell contact portions 420 is a part to be in contact with an inside of the shell 30 when the shell 30 is attached to the connector body 20. With this structure, the mid-plate 400 and the shell 30 are electrically connected to each other.

Referring to FIG. 4, the main portion 430 extends from the base portion 410 in the first direction. In detail, the main portion 430 extends forward or in the positive X-direction from the base portion 410. The main portion 430 has a plate-like shape and is held by the plate-like portion 110 of the holding member 100. The main portion 430 is located between and apart from the lock portions 450 in the second direction. Referring to FIGS. 5 and 6, the main portion 430 is located between the contact portion rows 310 and 320 in the third direction. As shown in FIGS. 4 and 6, the main portion 430 has side edges 432 oriented outward in the second direction.

Figure 7:
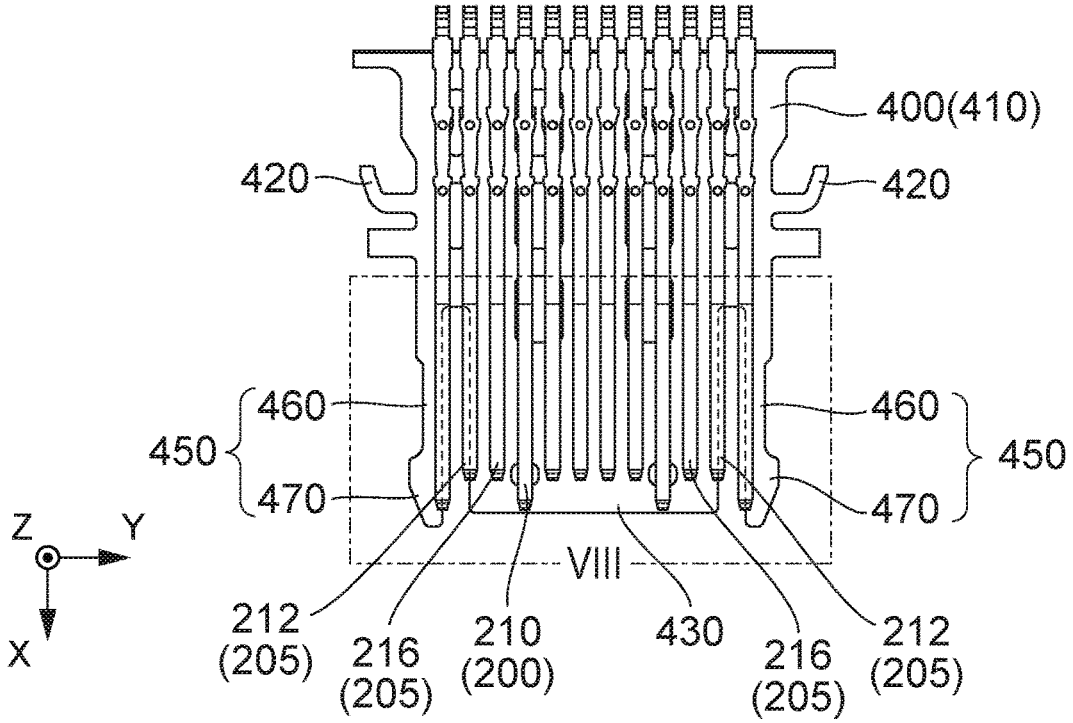
FIG. 7 is a top view showing contacts and a mid-plate which are included in the connector body of FIG. 2.
Figure 8:
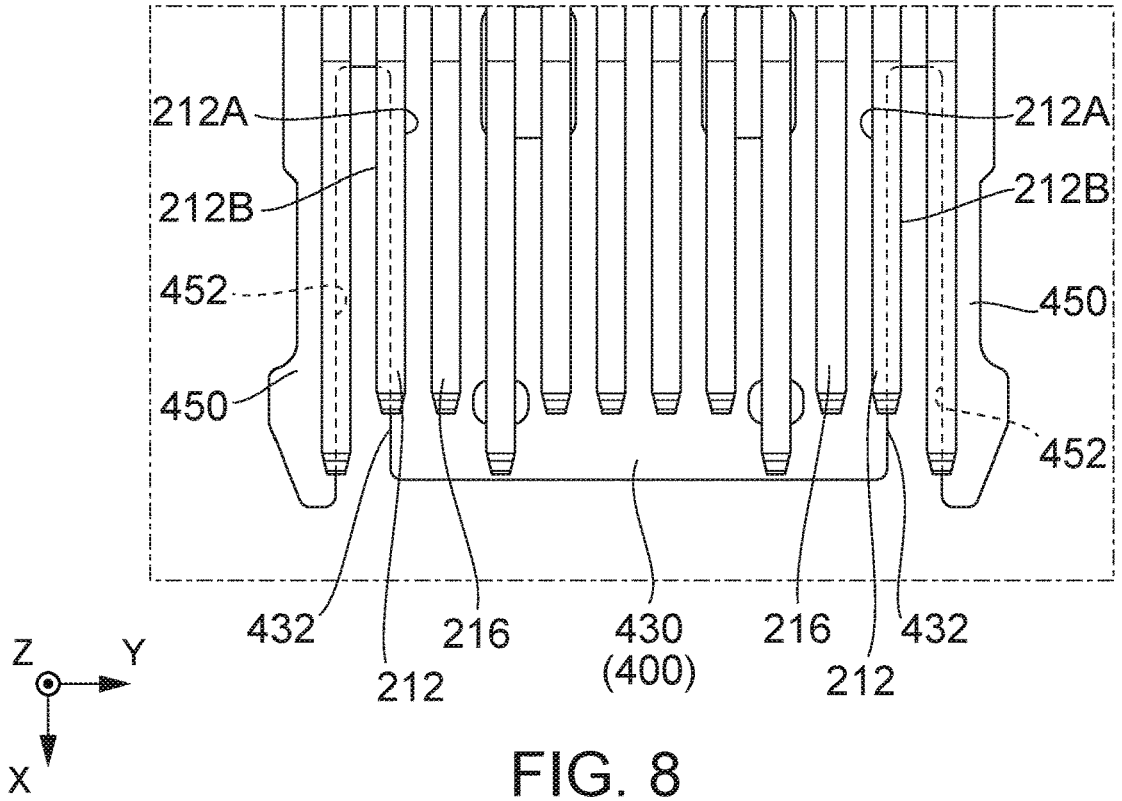
FIG. 8 is an enlarged view showing parts of the contacts and parts of the mid-plate of FIG. 7 that are surrounded by a rectangular frame VIII.

As understood from FIGS. 6, 7 and 8, the main portion 430 of the present embodiment lies between the contact portions 210 of the contact portion row 310 and the contact portions 210 of the contact portion row 320 except for the contact portions 210 located both ends of the contact portion rows 310 and 320 in the second direction. In the second direction, each of the side edges 432 of the main portion 430 is located outward of the inner edges 212A of the outer contact portions 212 which are juxtaposed in the third direction and closer to the side edge 432. In detail, as shown in FIG. 6, one of the side edges 432 of the main portion 430 is located, in the second direction, between the inner edges 212A of the outer contact portions 212 which are juxtaposed in the third direction and closer to the side edge 432 and one of the lock portions 450 which is closer to the edge 432. In more detail, the side edge 432 of the main portion 430 is located, in the second direction, inward of the outer edges 2128 of the outer contact portions 212 which are juxtaposed in the third direction and closer to the side edge 432. Similarly, the other of the side edges 432 is located, in the second direction, between the inner edges 212A of the outer contact portions 212 which are juxtaposed in the third direction and closer to the side edge 432 and one of the lock portions 450 which is closer to the side edge 432. Although the following description will be directed to one of the side edges 432 and the vicinity thereof, the same is true of the other of the side edges 432 and the vicinity thereof. The inner contact portions 216 juxtaposed in the third direction are partitioned by the main portion 430. Moreover, the inner contact portion 216 of the contact portion row 310 and the outer contact portion 212 of the contact portion row 320 are also partitioned by the main portion 430. Similarly, the outer contact portion 212 of the contact portion row 310 and the inner contact portion 216 of the contact portion row 320 are also partitioned by the main portion 430. Furthermore, the outer contact portions 212 juxtaposed in the third direction are partitioned by the main portion 430 at least in part. Therefore, cross talk between the differential pairs is suppressed, and thereby transmission characteristics of the connector are improved.

As shown in FIG. 4, the lock portions 450 extend from the base portion 410 in the first direction. In detail, the lock portions 450 extend forward or in the positive X-direction from the base portion 410. As understood from FIGS. 1, 2 and 12, the lock portions 450 and the mating lock portions 720 are designed to lock a mated state of the connector 10 and the mating connector 700.

As shown in FIG. 4, each of the lock portions 450 has a spring portion 460 and a lock protrusion 470 supported by the spring portion 460. The lock protrusion 470 protrudes outward in the second direction.

As shown in FIGS. 4 and 8, each of the lock portions 450 has an inner side edge 452 oriented inward in the second direction. The inner side edges 452 of the lock portions 450 and the side edges 432 of the main portion 430 extend in parallel with one another. The inner side edges 452 of the lock portions 450 face the side edges 432 of the main portion 430, respectively, in the second direction. There is a space 500 between each of the inner side edges 452 and the side edge 432 which face each other. In detail, each of the spaces 500 extends linearly in the first direction. The space 500 extends to a closed position where the main portion 430 and each of the spring portions 460 are connected to each other. This linear extending of the spaces 500 is one structural characteristic caused by pulling a die out along the first direction when the insert molding mentioned later is carried out.

As shown in FIGS. 4 and 6, the space 500 is provided between the main portion 430 and each of the lock portions 450 to allow resilient deformation of each of the spring portions 460. As understood from FIGS. 1, 4, 6 and 10, the lock portions 450 can be resiliently bent by using resilient deformation of the spring portions 460 and the spaces 500 when the connector 10 and the mating connector 700 are mated with each other. Accordingly, abrasion of the lock protrusions 470 is reduced when the connector 10 is mated with the mating connector 700, and thereby the durability of the connector 10 is improved.

Additionally, the lock portions 450 according to the present embodiment are formed by applying appropriate forces directed inward in the second direction to the lock protrusions 470 to resiliently deform the lock portions 450 and to separate the lock portions 450 from the holding member 100 after the insert molding of the holding member 100 in conjunction with the mid-plate 400. Before the insert molding, the lock portions 450 may be applied with mold lubricant.

Although the specific explanation about the present invention is made above referring to the embodiments, the present invention is not limited thereto but susceptible of various modifications and alternative forms.

Figure 9:
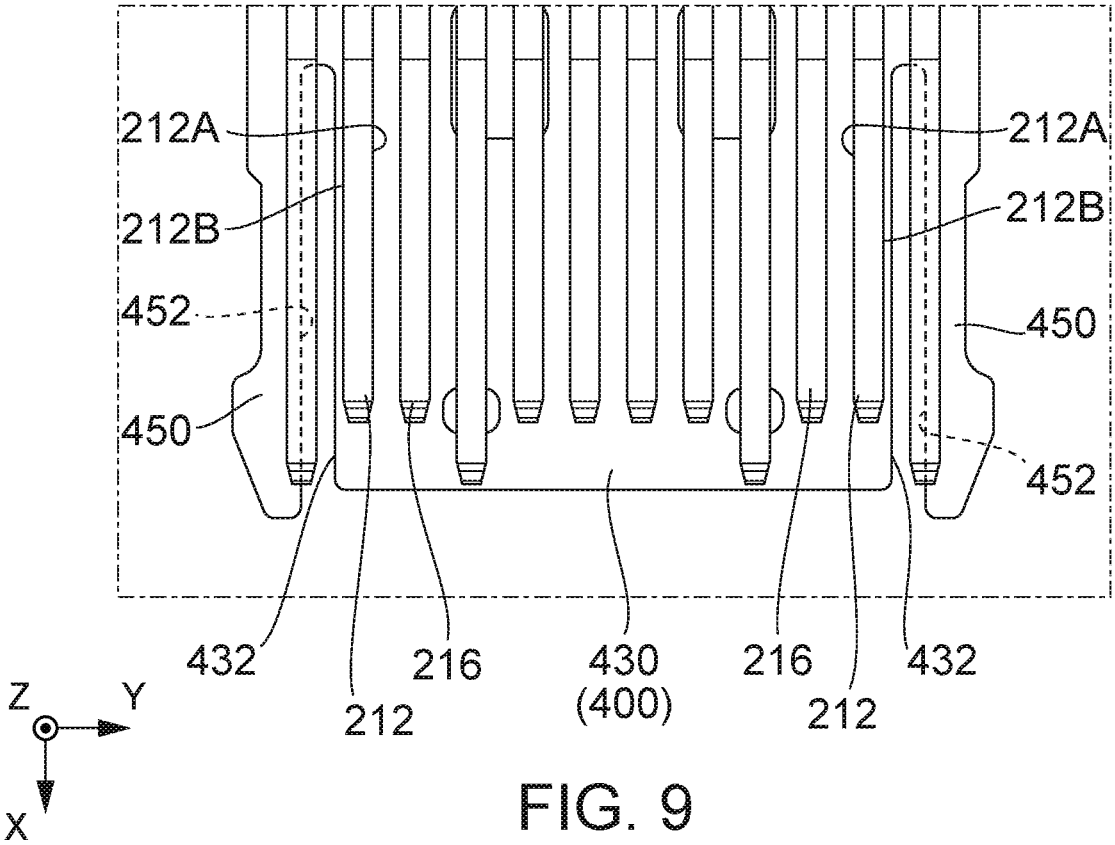
FIG. 9 is an enlarged view, which corresponds to FIG. 8, showing parts of contacts and parts of a mid-plate of a connector according to a modified example.

As described before, the side edges 432 of the main portion 430 according to the present embodiment are located inward of the outer edges 2128 of the outer contact portions 212 in the second direction. In other words, each of the side edges 432 is located between the outer edges 2128 of the outer contact portions 212 closer to the side edge 432 and the inner edges 212A of the outer contact portions 212 closer to the side edge 432 in the second direction. However, the present invention is not limited thereto. As shown in FIG. 9, each of the side edges 432 of the main portion 430 may be located between the outer edges 2128 of the outer contact portions 212 closer to the side edge 432 and one of the lock portions 450 closer to the side edge 432 in the second direction, for example.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable, along a first direction, with a mating connector having mating lock portions, wherein:

the connector comprises a connector body;

the connector body comprises a holding member, a plurality of contacts, a mid-plate, and two lock portions;

the holding member has a plate-like portion;

the plurality of contacts include contacts forming at least two differential pairs;

each of the plurality of contacts has a contact portion;

the contact portions of the plurality of contacts are held by the plate-like portion to form two contact portion rows;

in each of the contact portion rows, the contact portions are arranged in a second direction perpendicular to the first direction and are exposed from the plate-like portion in a third direction perpendicular to both of the first direction and the second direction;

each of the contact portion rows includes the contact portions of the contacts forming at least one of the differential pairs;

the contact portions of the contacts forming each of the differential pairs comprise an outer contact portion located outward in the second direction and an inner contact portion located inward in the second direction;

the outer contact portion has an inner edge oriented inward in the second direction and an outer edge oriented outward in the second direction;

in the second direction, the outer contact portion and the inner contact portion which are included in one of the contact portion rows are respectively located at same positions as positions of the outer contact portion and the inner contact portion which are included in a remaining one of the contact portion rows;

each of the lock portions has a spring portion and a lock protrusion supported by the spring portion;

the lock protrusion protrudes outward in the second direction;

the lock portions and the mating lock portions lock a mated state of the connector and the mating connector;

the mid-plate has a main portion having a plate-like shape;

the mid-plate is partly embedded in the holding member by insert molding;

the main portion is held by the plate-like portion;

the main portion is located between and apart from the lock portions in the second direction and located between the contact portion rows in the third direction;

the main portion has side edges oriented outward in the second direction;

between the main portion and each of the lock portions, a space is provided to allow resilient deformation of the spring portion; and one of the side edges of the main portion is located between the inner edge of the outer contact portion and one of the lock portions that is closer to the outer contact portion in the second direction.

2. The connector as recited in claim 1, wherein one of the side edges of the main portion is located between the outer edge of the outer contact portion and one of the lock portions that is closer to the outer contact portion in the second direction.

3. The connector as recited in claim 1, wherein the lock portions are integrally formed with the mid-plate.

4. The connector as recited in claim 1, wherein:

each of the lock portions has an inner side edge oriented inward in the second direction; and the inner side edge of the lock portion extends in parallel with the side edges of the main portion.

* * * * *